US008113026B2

(12) United States Patent
Ferrario

(10) Patent No.: US 8,113,026 B2
(45) Date of Patent: Feb. 14, 2012

(54) APPARATUS AND METHOD FOR REDUCING THE SECTION AND SIZING OF ROLLING MILL PRODUCTS FOR WIRE ROD

(75) Inventor: Giuseppe Ferrario, Legnano-Milano (IT)

(73) Assignee: Siemens VAI Metals Technologies S.R.L., Castellanza-Varese (IT)

( * ) Notice: Subject to any disclaimer, the term of this patent is extended or adjusted under 35 U.S.C. 154(b) by 779 days.

(21) Appl. No.: 11/663,522

(22) PCT Filed: Jul. 18, 2005

(86) PCT No.: PCT/EP2005/007866

§ 371 (c)(1),
(2), (4) Date: Mar. 21, 2007

(87) PCT Pub. No.: WO2006/037388

PCT Pub. Date: Apr. 13, 2006

(65) Prior Publication Data

US 2008/0110228 A1 May 15, 2008

(30) Foreign Application Priority Data

Oct. 6, 2004 (IT) ..... MI2004A1897

(51) Int. Cl.
*B21B 39/00* (2006.01)

(52) U.S. Cl. ..... 72/226; 72/234

(58) Field of Classification Search ..... 72/235, 72/234, 225, 224, 226
See application file for complete search history.

(56) References Cited

U.S. PATENT DOCUMENTS

| | | | | |
|---|---|---|---|---|
| 4,050,280 | A * | 9/1977 | Sayer | 72/234 |
| 4,289,011 | A * | 9/1981 | Yoshiwara et al. | 72/208 |
| 5,325,697 | A | 7/1994 | Shore et al. | |
| 6,314,781 | B1 | 11/2001 | Nagase | |
| 2003/0136169 | A1 | 7/2003 | Lemke | |

FOREIGN PATENT DOCUMENTS

| | | | |
|---|---|---|---|
| CN | 1040848 | C | 11/1998 |
| EP | 0512735 | A2 | 11/1992 |
| JP | 2000301204 | | 10/2000 |

OTHER PUBLICATIONS

International Search Report, Oct. 10, 2005.
English translation of Chinese Office Action dated Jan. 8, 2010.

* cited by examiner

*Primary Examiner* — Debra Sullivan
(74) *Attorney, Agent, or Firm* — Laurence A. Greenberg; Werner H. Stemer; Ralph E. Locher

(57) ABSTRACT

An apparatus is provided for reducing the section and sizing of rolling mill products for wire rod. The apparatus includes a first finishing monoblock made up of a plurality of rolling stands that are arranged in a sequence suitable for forming a rolling line. The apparatus also includes a second monoblock that is suitable for giving the product a round section with narrow tolerances. The second monoblock includes a sequence of stands with grooves configured to give a round-oval-round-round section to the product.

12 Claims, 1 Drawing Sheet

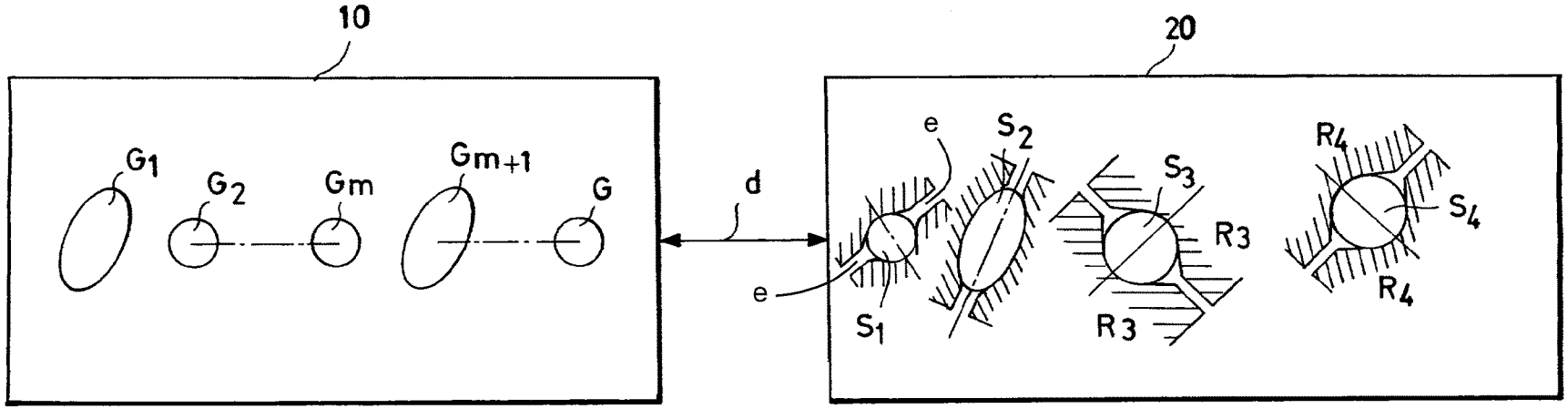
20
10
d
e
e
S1
S2
S3
S4
R3
R3
R4
R4
G1
G2
Gm
Gm+1
G

APPARATUS AND METHOD FOR REDUCING THE SECTION AND SIZING OF ROLLING MILL PRODUCTS FOR WIRE ROD

BACKGROUND OF THE INVENTION

Field of the Invention

The present invention refers to an apparatus and method for reducing the section and sizing of rolling mill products for wire rod.

In a rolling plant or rolling mill for wire rods, according to well-established technology, one operates on a billet previously taken to a higher temperature than the re-crystallization temperature to then subject it to rolling so as to gradually reduce its section up to the desired section.

In the rolling mill, one of the critical operations therefore consists of the finishing carried out through a plurality of rolling stands. The plurality of rolling stands reduce the size of the billet that produces the wire rod that is sent to the sizing monoblock or that is sent directly to the laying head.

Currently, rolling mills for producing wire rod are constructed in different ways.

They can comprise a monoblock group with 6-8-10 rolling stands controlled by a single motor, with a succession of oval-round reductions followed a certain distance behind by a second group of monoblock stands that can be formed from a group of four stands with oval-round-round-round reduction sequence.

A rolling mill of this type forms the object of European patent no. 0 51 to Morgan.

Another type of known rolling mill foresees a monoblock group with 6-8-10 rolling stands as above followed by two groups of stands each formed from two stands with oval-round reduction sequence in the first group and oval-round in the second group.

Each group is controlled by a motor.

Since one problem of production is linked to the large number of formed products, i.e. of the required diameters, it is necessary to make the rolling mill flexible so as to be able to carry out quick changes in equipment and in rolling rings.

The reduction sequences, in the first and in the second monoblock, are carried out according to a prior art that allows the changes in the first monoblock to be minimised and the entire range of foreseen diameters, which normally range from a diameter of 5.5 mm to maximum diameters of 18-22 mm, to be finished in the second monoblock.

A particularly disadvantageous condition in plants of this type-consists of the fact that the synchronization between the output speed of the rolled product from the first monoblock and the input speed into the second group of stands (monoblock) is extremely difficult for which reason the speed of the second monoblock tends to be adjusted with a slightly greater speed than the output speed of the first monoblock so that the material between the two groups is always in slight pull.

The value of the speed difference must be such as to contain within its range all normal variations, even if small, in readjustment of speeds, which occur each time a load is taken relative to the succession of billets being rolled.

The consequence of what has been outlined above causes a substantial variation in the section of the rolled product between the first monoblock and the second monoblock.

The variation in section indicated above, which occurs along the entire billet, reaches its maximum at the start and end of the billet, where there is no pull. Moreover, already inside the first monoblock there are pulls between the stands such as to generate substantial variations in section already in output from it.

The aforementioned variations in section between the two monoblocks are the cause of substantial problems in the second monoblock since they greatly reduce the lifetime of the rolling guides, they produce large variations in filling of the oval groove and consequently large variations in roundness in the subsequent grooves if they have large recesses with extension beyond the edge if the grooves cover the full 360°.

The substantial variations in section in the initial portion of the rolled product, as stated above, determine an increase in the entry angle to the second monoblock both for the round section that enters into the oval, and for the subsequent section that enters the finishing round stock. Said large entry angles are the cause of frequent cobbles.

It is also known to men skilled in the art that a sections with errors in roundness is unstable since it tends to rotate and be arranged according to the minimum height to which the minimum rolling pressure corresponds.

BRIEF SUMMARY OF THE INVENTION

The general purpose of the present invention is, therefore, that of providing an apparatus and method suitable for allowing the solution of the problems outlined above with the aim at obtaining a rolled product with narrow tolerances and with greater reliability of operation.

In view of the aforementioned purposes, according to the present invention, it has been thought to make an apparatus and a method having the characteristics outlined in the subsequent claims.

BRIEF DESCRIPTION OF THE SEVERAL VIEWS OF THE DRAWING

The morphological and functional characteristics of the present invention as well as its advantages compared to the prior art shall become clearer from an examination of the following description, referring to the attached FIGURE that schematically illustrates the sections of the product in the passage in each of the rolling stands of the apparatus.

DESCRIPTION OF THE INVENTION

With reference to the FIGURE, the apparatus for reducing the section and sizing of rolling mill products for wire rod, object of the present invention, comprises: rolling of a first monoblock 10 consisting of a sequence of rolling stands in a variable number (G1-Gn) where the last stands Gm-Gn have the grooves with oval-round sequence with large recesses to minimize the risks of overfill beyond the edge of the initial and end part of the rolled round stock from each billet and to make the distribution of the spread more uniform.

A second monoblock 20, arranged a suitable distance d from the first monoblock 10 such as to allow the cooling of the product coming out from said monoblock 10 at a predetermined temperature and sufficiently equalized in section, consisting of:

at least one first stand S1 equipped with a suitable rolling guide with a round groove so as to reduce the variations in section arriving into the output section, and also making it easier to bite the rolled product as a consequence of the small grip angle. The stand S1, at the start of the second monoblock, has a round groove with suitable recesses to make it easier to bite the round stock with increased size at the end caused by the pulling of the rolled material inside the first monoblock 10.

a second subsequent stand S2 with an oval groove to generate an oval of constant width and thickness along the entire rod.

a third subsequent stand 83 with a round groove that produces a finished round stock on the height of the profile.

a fourth stand 84 follows the third stand 83 and has a rolling ring R4 rotated by 90° with respect to the corresponding rolling ring R3 of the third stand 83.

Such rollers are equipped with the same groove as those of said third stand S3.

In the fourth stand S4, it is foreseen to eliminate the variation in width of the round stock coming out from the previous stand and to thus obtain a product with narrow tolerances.

The method for making a wire rod according to the present invention comprises the following steps:

a) feeding the product to be rolled to a first finishing monoblock comprising a number of rolled stands (G1-Gn) selected according to the rolled diameter and having a number of last stands (Gm-Gn) with grooves with large recesses to minimize the risks of extension beyond the edge of the initial and end part of the round stock from each billet and to make the distribution of the spread more uniform;

b) feeding the product coming out from the first monoblock into a second monoblock 20, arranged a suitable distance (d) from said first monoblock 10 so as to allow the rolling of the product in the second monoblock at a predetermined temperature, feeding the product into a sequence of round-oval-round-round stands, foreseen in said second monoblock 20.

The invention claimed is:

1. An apparatus for reducing a section and a size of a rolling mill product for wire rod, comprising:

a first finishing monoblock including a plurality of rolling stands disposed in a sequence for forming a rolling line, wherein said first finishing monoblock has a plurality of last stands with grooves having an oval-round sequence; and a second monoblock suitable for giving the product a round section with narrow tolerances, said second monoblock including a sequence of stands with grooves configured to give the product a round-oval-round-round section;

wherein said sequence of stands of said second monoblock includes a first stand that is equipped with a suitable rolling guide having a round groove so as to reduce variations in section arriving into the second monoblock.

2. The apparatus according to claim 1, wherein said second monoblock is disposed a distance away from said first monoblock in order to allow the product to roll in the second monoblock at a predetermined temperature.

3. The apparatus according to claim 1, wherein:

said product is a rod; and said second monoblock includes at least a first stand equipped with a rolling guide having a round groove to generate a round stock with negligible variations in section along the rod.

4. The apparatus according to claim 3, wherein:

the round stock is made of rolled material and has an end with an increased size caused by pulling of the rolled material inside said first monoblock; and said at least one stand is located at a beginning of the second monoblock and has a round groove with recesses that make it easier to bite the round stock that has the end with the increased size.

5. The apparatus according to claim 3, wherein said second monoblock includes a second subsequent stand with an oval groove to generate an oval with a constant width and a constant thickness along all of said rod.

6. The apparatus according to claim 5, wherein said second monoblock includes a third subsequent stand with a round groove to generate a finished round stock on a height of all of said rod.

7. The apparatus according to claim 6, wherein:

said third stand includes rolling rolls; and said second monoblock includes a fourth subsequent stand having rolling rolls that are rotated by 90 degrees with respect to said rolling rolls of said third stand.

8. The apparatus according to claim 7, wherein said fourth stand eliminates a variation in a width of the round stock coming out from said third stand so as to provide a product with narrow tolerances along all of said rod.

9. A method for reducing a section and a size of rolling mill products for wire rod, the method which comprises:

feeding the product to be rolled to a first finishing monoblock including a number of rolling stands selected according to a rolled diameter and having a plurality of last stands having grooves with large recesses to minimize risks of overfill beyond an edge of an initial and an end part of a rolled round stock from each billet and to make a distribution of spread more uniform, wherein the first finishing monoblock has a plurality of last stands with grooves having an oval-round sequence;

feeding the product coming out from the first monoblock to a second monoblock disposed a distance from said first monoblock so as to allow rolling of the product in the second monoblock at a predetermined temperature;

wherein the step of feeding the product to the second monoblock includes feeding the product into a sequence of round-oval-round-round stands in said second monoblock; and wherein the sequence of round-oval-round-round stands in the second monoblock includes a first stand that is equipped with a suitable rolling guide having a round groove so as to reduce variations in section arriving into the second monoblock.

10. The method for according to claim 8, wherein the step of feeding the product to the second monoblock includes feeding the product to a second subsequent stand with an oval groove to generate an oval of constant width and thickness along all of the rod.

11. The method for according to claim 10, wherein the step of feeding the product to the second monoblock includes feeding the product to a third subsequent stand with a round groove that produces a finished round stock on a height of all of the rod.

12. The method for according to claim 11, wherein the step of feeding the product to the second monoblock includes feeding the product to a fourth stand following the third stand and having rolling rolls rotated by 90 degrees with respect to corresponding rolling rolls of the third stand in order to eliminate a variation in width of a round stock coming out from the third stand and to thus obtain a product with narrow tolerances.

* * * * *